US005764599A

United States Patent [19]

Thorgersen et al.

[11] Patent Number: 5,764,599

[45] Date of Patent: Jun. 9, 1998

[54] ELECTROLUMINESCENT LAMP AND DIAL FOR A TIMEPIECE

[75] Inventors: Harold Thorgersen, Woodbury; Anthony Rinaldi, Jr., Watertown, both of Conn.

[73] Assignee: Timex Corporation, Middlebury, Conn.

[21] Appl. No.: 693,687

[22] Filed: Aug. 12, 1996

[51] Int. Cl.[6] ..... G04B 19/32

[52] U.S. Cl. ..... 368/226

[58] Field of Search ..... 368/226, 239–243, 368/79, 82–84

[56] References Cited

U.S. PATENT DOCUMENTS

| | | | |
|---|---|---|---|
| 3,749,977 | 7/1973 | Sliker | 315/276 |
| 4,775,964 | 10/1988 | Alessio et al. | 368/67 |
| 4,792,723 | 12/1988 | Igarashi et al. | 315/503 |
| 4,849,673 | 7/1989 | Werring et al. | 315/506 |
| 5,265,071 | 11/1993 | Thorgersen et al. | 368/67 |
| 5,346,718 | 9/1994 | Thorgersen et al. | 427/66 |
| 5,491,379 | 2/1996 | Daigle et al. | 313/509 |

*Primary Examiner*—Bernard Roskoski
*Attorney, Agent, or Firm*—William C. Crutcher

[57] ABSTRACT

An electroluminescent lamp constructed by screen printing, in succession on a rigid metal plate in the shape of a watch dial, a first of barium titanate, a second layer of phosphor particles in a polymerizable binder, a light transmissive third layer of indium tin oxide, and a conductive peripheral ring of silver epoxy. A transparent dial overlay of Mylar™ film with timekeeping indicia fits within the conductive ring. The conductive ring and the substrate serve as the electrodes for the lamp, which illuminates the dial overlay.

11 Claims, 1 Drawing Sheet

ELECTROLUMINESCENT LAMP AND DIAL FOR A TIMEPIECE

BACKGROUND OF THE INVENTION

This invention relates generally to improvements in illuminated dials for timepieces, and more particularly to an improved electroluminescent lamp for a timepiece.

Electroliminescent lamps are well known as devices to illuminate timepiece dials, either from the front or from the back as a substitute for other light sources. FIG. 1 of the drawing illustrates a prior art electroluminescent panel 110 comprising an integral substrate 112 such as polystyrene or polypropylene film. Applied to one side of the film is a dielectric material 114 having luminescent phosphor crystallites 116 imbedded therein. Upper and lower electrodes 117, 118 are applied to the upper surface of the dielectric material 114 and to the lower surface of substrate 112, respectively, at least one of which electrodes is of light transparent material. Connected to the electrode layers 117, 118 are respective conductors 120, 122 leading to a source of alternating current 124 and connected in series between the source 124 and the electrodes is an inductor 126. This prior art electroluminescent panel is disclosed in U.S. Pat. No. 3,749,977 issued Jul. 31, 1973 to Lawrence S. Sliker, which also discloses suitable EL drive circuits represented by the alternating current source 124.

A prior art illuminated dial for a timepiece is disclosed in U.S. Pat. No. 4,775,964 issued Oct. 4, 1988 to Alessio et al. and assigned to the Applicant's assignee. This prior art illuminated dial is shown in FIG. 2 of the drawing, where the timepiece dial comprises the substrate on which electroluminescent layer elements are deposited. As shown in FIG. 2, the timepiece case 2 contains the watch hands 3, 4 mounted upon coaxial rotating stems 10, 11, connected to a watch movement 12. The case 2 includes a transparent crystal 13 through which to observe the hands 3, 4 and their position in relation to indicia 8, 9 on the dial 7. An electroluminescent drive circuit 14 supplies drive pulses via output leads 15. Dial 7 is mounted in case 2 by means of an insulating gasket 16, which electrically insulates it from case 2.

Dial 7 comprises a transparent substrate 17 of Mylar™ film having an electrically conductive transparent layer 18 of indium tin oxide (ITO). A phosphor/binder electroluminescent layer 19 is applied to layer 18. The electroluminescent layer 19 comprises encapsulated phosphor particles in a polymerized suspension medium. A layer 20 of insulating dielectric material having reflective qualities, such as barium titanate, is deposited onto layer 19, and lastly a conductive electrode layer 21 of metallic aluminum is applied on top of layer 20 by vapor deposition. Timekeeping indicia 8, 9 are printed on the opposite side of substrate 17. The aforementioned dial 7 is provided with a central aperture 22 for accommodating the rotatable stems 10, 11. The leads 15 are connected to electrodes 18, 21 at connection points **15*a*, 15*b* respectively of dial 7, which is electrically floating with respect to the grounded watch case 2**.

While the electroluminescent dial described in FIG. 2 has been highly successful, the connections to the imbedded ITO electrode layer 18 are difficult. If the dielectric and electroluminescent materials are removed to allow connection as shown in FIG. 2, an undesirable dark spot appears on the dial. This has lead to several improvements in means to connect to the electrodes and/or eliminate dark spots, which are shown in U.S. Pat. No. 5,265,071 issued Nov. 23, 1993 to Thorgersen et al., U.S. Pat. No. 5,346,718 issued Sep. 13, 1994 to Thorgersen et al., and U.S. Pat. No. 5,491,379 issued Feb. 13, 1996 to Daigle et al. All of the aforesaid patents are assigned to the Applicant's assignee.

Avoidance of the above mentioned connection problems requires precise manufacturing control in cutting the parts and printing the timekeeping indicia on the watch dials. Simplified constructions would be desirable which do not require such precise manufacturing controls, which would reduce the cost and improve the performance of electroluminescent lighted watch dials.

Accordingly, one object of the present invention is to provide an improved electroluminescent lamp and dial for a timepiece.

Another object of the invention is to provide an improved electroluminescent lamp which is economical to manufacture and utilize in a timepiece having an illuminated dial.

SUMMARY OF THE INVENTION

Briefly stated, the invention comprises an improved electroluminescent lamp and dial for a timepiece comprising a rigid flat conductive metal substrate having a periphery in the shape of a timepiece dial to be illuminated, a first layer of insulating reflective dielectric material disposed on the substrate, a second layer of electroluminescent material comprising a monolayer of moisture-resistant encapsulated phosphor particles in a polymerized suspension medium disposed on the first layer, a third layer of electrically conductive particles disposed on the second layer in a film sufficiently thin to be light transmissive but sufficiently thick to be partially electrically conductive throughout, an electrically conductive peripheral ring disposed in electrical contact with the third layer around the periphery of the substrate, an electroluminescent drive circuit having a pair of output terminals, and means connecting one of the output terminals to the metal substrate and the other output terminal to the peripheral ring. A timepiece dial is disposed to be illuminated by the electroluminescent lamp, preferably comprising a transparent overlay having timekeeping indicia thereon adapted to fit within the peripheral ring.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

FIG. 1 is an elevation drawing in cross section of a prior art electroluminescent lamp, FIG. 2 is an elevational view in cross section of portions of a prior art timepiece in simplified form, FIG. 3 is a side elevational view in cross section, in simplified form of an improved electroluminescent lamp according to the present invention, FIG. 4 is a side elevational view, in cross section, of a timepiece in simplified form utilizing the lamp of FIG. 3 in a timepiece, and FIG. 5 is a top plan view of a timepiece dial and lamp before assembly into the timepiece of FIG. 4.

DESCRIPTION OF THE PREFERRED EMBODIMENT

Figure 3:
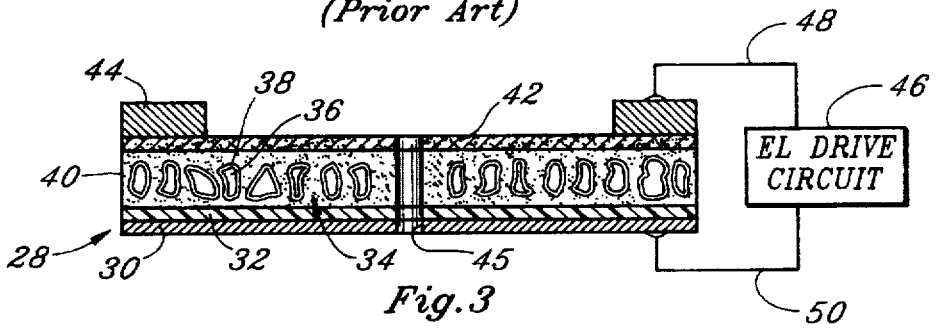

Referring now to FIG. 3 of the drawing, a cross section is shown through an electroluminescent lamp indicated generally by reference numeral 28, is constructed according to the present invention in its preferred form. The layers shown in the drawing are not to scale and are exaggerated for the purpose of understanding the construction. The lamp 28 is constructed on a rigid flat conductive metal plate 30 which serves as the substrate and also the lower electrode. Suitable materials are brass or aluminum and substrate 30 should be of sufficient thickness to undergo the various manufacturing processes to be described, and to support the electroluminescent lamp and dial components in a timepiece. The substrate may be stamped or die cut out of a roll of brass or aluminum strip. Next, onto substrate 30, an insulating and light reflective layer 32, such as barium titanate is deposited. This may be applied by a thin film process such as vacuum deposition, but preferably it is screen printed by conventional techniques to reduce the cost. Next, a second layer 34 of electroluminescent phosphor particles, such as ZnS:Cu in an appropriate suspension medium is deposited on the first layer. The phosphor particles, shown by reference numeral 36, in the drawing are encapsulated with a coating 38 which renders them resistant to moisture, using a technique such as described in U.S. Pat. No. 5,418,062. The suspension medium 40 is a polymerizable resin which is cured after deposition. Second layer 34 is spread such that the phosphor particles are disposed in a "monolayer" (one particle in thickness) as indicated in the exaggerated drawing of FIG. 3.

A third layer 42 of electrically conductive particles is then applied to layer 34 after it has cured. Layer 42 preferably comprises indium tin oxide (ITO) particles in a fluid suspension medium applied by screen printing.

Figure 1:
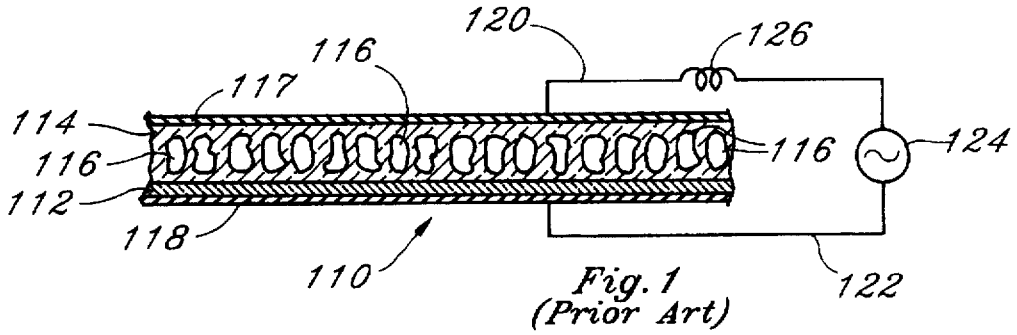
Fig. 1 (Prior Art)
Figure 2:
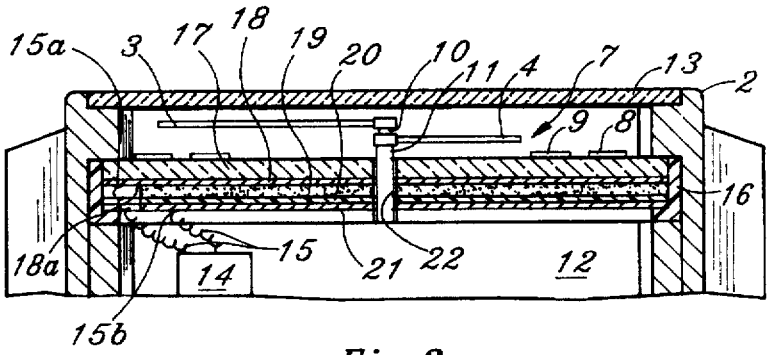
Fig. 2 (Prior Art)

While indium tin oxide is a good conductor as usually applied by vacuum deposition to a Mylar™ substrate, as shown in the prior art FIG. 2 description above, it is a relatively poor conductor when applied by the screen printing techniques preferred in the present invention. This is apparently because electrical conductivity relies upon contact from one particle to the next, as opposed to a monolithic film produced by vacuum deposition. Layer 42 must be sufficiently conductive to act as an electrode in an electroluminescent device, which is essentially a capacitive device, but the layer must be thin enough to allow for substantial transmission of light from the electroluminescent particles 36 through layer 42. A suitable thickness for layer 42 is in the range between 0.01 mm and 0.05 mm when it consists of indium tin oxide screen printed upon layer 34. When the layer 42 is at least 0.01 mm thick it will be "partially conductive" for the purposes of this invention. By partially conductive, we mean having resistivity on the order of 500 ohms per square. Yet, if it is too thick it will not be sufficiently light transmissive, 0.05 mm being a desirable upper value. These thickness ranges may vary depending on the materials used for layer 42.

Lastly, an electrically conductive peripheral ring 44 of a highly conductive material such as a silver epoxy is deposited on the third layer around the periphery of the substrate. The conductive peripheral ring 44 serves to distribute the electrical charge uniformly around the periphery to the layer 42 which acts as the electrode for the lamp, thereby improving light output over that which would take place if a point contact were made to the front electrode 42.

The completed lamp 28 is furnished with a central aperture 45 by drilling or punching. Lastly, after assembly into the timepiece, an electroluminescent drive circuit 46, connected to a power source (not shown), has a pair of terminals, one of which is electrically connected to peripheral ring 44 via lead 48 and the other of which is electrically connected to the substrate electrode 30 via lead 50.

Figure 4:
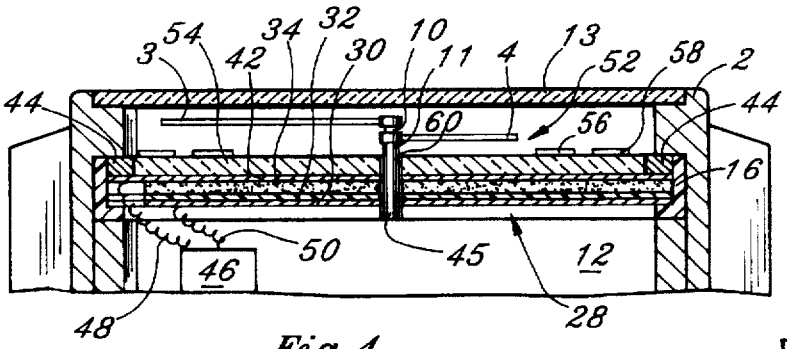

Referring now to FIG. 4 of the drawing, a cross section through a timepiece is shown, which timepiece may be identical to that shown in FIG. 2, comprising a watch case 2 having a movement 12, a transparent lens 13, through which may be viewed the watch hands 3, 4 rotatable on stems 10, 11 respectively. An electroluminescent lamp assembly 28 corresponding to the one shown in FIG. 3 is supported in insulating gasket 16. Frame 2 is in electrical contact with the electrically conductive peripheral ring 44, which is thereby connected to ground and one side of the power source (not shown). An EL drive circuit 46 incorporated into movement 12, has a pair of output terminals (not shown). One output terminal is connected via lead 48 connected to watch case 2 and thereby to the electrically conductive ring 44. The other output terminal is connected via lead 50 is connected to substrate 30, thereby providing a much simpler electrical connection to the electroluminescent lamp 28 than the prior art arrangements.

A timepiece dial, with indicia is disposed to be illuminated by EL lamp 28. This may comprise a transparent watch dial overlay, indicated generally by reference numeral 52. Dial overlay 52 comprises a transparent film 54 such as Mylar™, having timekeeping indicia 56, 58 printed thereon. The overlay 52 is arranged to fit inside the ring 44 and also includes a central aperture 60 aligned with aperture 45.

Figure 5:
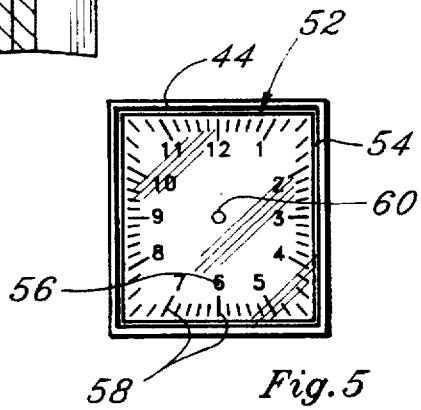

Reference to FIG. 6 of the drawing shows how overlay 52 is arranged to fit within the peripheral ring 44. The timekeeping indicia may comprise numerals at 56 and/or markers at 58. Although FIG. 5 illustrates a rectangular overlay 52 within a rectangular peripheral ring 44, obviously the ring and overlay could be circular, elliptical or any desired shape.

In operation, the EL drive circuit 46 is selectively activated to supply drive pulses of alternating polarity to electrode 30 and to electrode 42 via conductive ring 44 so as to cause the electroluminescent particles 36 to luminesce. The light transmitted through the light transmissive electrode layer 42 illuminates the dial overlay 52 from beneath so that timekeeping indicia 56, 58 may be observed in the dark.

While the peripheral ring 44 is described as deposited directly upon the layer 42, ring 44 can be a separate ring comprising part of the watch bezel which makes direct contact with the periphery of layer 42 to function as described.

Also it is possible to imprint timekeeping indicia 56, 58 directly upon the conductive layer 42, which thereby serves as the watch dial without the need for a transparent dial overlay.

While there has been shown what is considered to be the preferred embodiment of the invention, other modifications will occur to those skilled in the art, and it is desired to secure in the appended claims all such modifications as fall within the true spirit and scope of the invention.

We claim:

1. An improved electroluminescent lamp and dial for a timepiece comprising:

a rigid flat conductive metal substrate having a periphery in the shape of a timepiece dial to be illuminated, a first layer of insulating reflective dielectric material disposed on said substrate, a second layer of electroluminescent material comprising a monolayer of moisture-resistant encapsulated phosphor particles in a polymerized suspension medium disposed on said first layer, a third layer of electrically conductive particles disposed on said second layer, in a film sufficiently thin to be light transmissive but sufficiently thick to be partially electrically conductive throughout, an electrically conductive peripheral ring disposed in electrical contact with said third layer about the periphery of said substrate, an electroluminescent drive circuit having a pair of output terminals, means connecting one of said output terminals to said metal substrate and the other of said output terminals to said peripheral ring, and a timepiece dial disposed to receive light from the second layer which is transmitted through the third layer so as to be illuminated by the electroluminescent lamp.

2. The combination in accordance with claim 1, wherein said timepiece dial comprises a transparent timepiece dial overlay having timekeeping indicia thereon adapted to fit within said peripheral ring.

3. The combination according to claim 1, wherein the metal substrate comprises a brass stamping.

4. The combination according to claim 1, wherein the metal substrate comprises an aluminum stamping.

5. The combination according to claim 1, wherein the first layer comprises barium titanate.

6. The combination according to claim 1, wherein the phosphor particles in the second layer comprise ZnS:Cu.

7. The combination according to claim 1, wherein the third layer of electrically conductive particles comprises indium tin oxide applied by screen printing.

8. The combination according to claim 7, wherein the third layer is at least 0.01 mm thick, so as to be partially conductive.

9. The combination according to claim 7, wherein the third layer is less than 0.05 mm thick, so as to be light transmissive.

10. The combination according to claim 1, wherein the timepiece dial comprises said third layer having timekeeping indicia printed directly thereon.

11. The combination according to claim 2, wherein the dial overlay comprises transparent plastic film having timekeeping indicia printed thereon.

* * * * *